US005382775A

United States Patent [19]

Lee

[11] Patent Number: 5,382,775

[45] Date of Patent: Jan. 17, 1995

[54] METHOD AND APPARATUS FOR AUTOMATIC COOKING IN A MICROWAVE OVEN

[75] Inventor: In K. Lee, Kyungsangnam-Do, Rep. of Korea

[73] Assignee: Goldstar, Co., Ltd., Seoul, Rep. of Korea

[21] Appl. No.: 813,823

[22] Filed: Dec. 27, 1991

[30] Foreign Application Priority Data

Dec. 28, 1990 [KR] Rep. of Korea ..... 22306/1990

[51] Int. Cl.[6] ..... H05B 6/66

[52] U.S. Cl. ..... 219/702; 219/707; 219/708; 219/710; 341/165; 380/28; 99/325

[58] Field of Search ..... 219/10.55 B, 10.55 E, 219/10.55 F, 10.55 M, 10.55 R, 10.55 A, 10.55 C, 492, 518, 702, 704, 707, 710, 708, 492, 518; 395/75; 99/325, 326, 327, DIG. 14; 341/165, 160, 165; 364/513, 807, 274.6, 513; 380/28

[56] References Cited

U.S. PATENT DOCUMENTS

| | | | |
|---|---|---|---|
| 4,481,394 | 11/1984 | Tanabe | 219/10.55 B |
| 4,590,350 | 5/1986 | Ueda | 219/10.55 B |
| 4,599,503 | 7/1986 | Ueda | 219/10.55 B |
| 4,874,928 | 10/1989 | Kasai | 219/492 |
| 4,880,142 | 11/1989 | Higuchi et al. | 222/56 |
| 4,914,924 | 4/1990 | Takahashi | 62/133 |
| 4,961,225 | 10/1990 | Hisano | 380/28 |
| 5,184,131 | 2/1993 | Ikeda | 341/165 |

FOREIGN PATENT DOCUMENTS

| | | |
|---|---|---|
| 0074764 | 3/1983 | European Pat. Off. . |
| 3205124 | 8/1983 | Germany . |
| 0244126 | 1/1991 | Japan . |
| 4006322 | 1/1992 | Japan . |
| 2173919 | 10/1986 | United Kingdom . |

OTHER PUBLICATIONS

Patent Abstracts of Japan, vol. 14, No. 206, Publication No. JP2044126, Publication Date Feb. 14, 1990.

*Primary Examiner*—Teresa J. Walberg
*Assistant Examiner*—Tu Hoang

[57] ABSTRACT

Method and apparatus for automatic cooking in a microwave oven capable of executing the automatic cooking in an optimal state by detecting an outflow air temperature and a weight of food at an initial stage, calculating an outflow air temperature difference after executing a cooking operation for a predetermined time, calculating an additional value by giving a fuzzy membership function to the outflow air temperature difference and the weight of food, calculating a first stage heating time by executing an operation process according to a fuzzy rule, calculating second to fifth stage heating times by multiplying the first stage heating time by predetermined values, respectively, and executing a cooking operation for the calculated stage heating times.

8 Claims, 9 Drawing Sheets

FIG. 6

| ΔT1 \ W1 | PS | PM | PB |
|---|---|---|---|
| PS | PM | PM | PL |
| PM | PS | PM | PL |
| PB | PS | PM | PM |

METHOD AND APPARATUS FOR AUTOMATIC COOKING IN A MICROWAVE OVEN

BACKGROUND OF THE INVENTION

1. Field of the Invention

The present invention relates to method and an apparatus for automatic cooking in a microwave oven which are capable of executing automatic cooking in an optimal state by detecting an outflow air temperature and a weight of food to be cooked and calculating a cooking time using detected signals relating to the outflow air temperature and the weight of food with fuzzy control.

2. Description of the Prior Arts

Various types of microwave cooking methods and apparati are well known in the art. One conventional microwave oven is illustrated in FIG. 1. As shown in FIG. 1, the conventional microwave oven comprises a microcomputer 1 for controlling the operation of the whole system, a driving section 2 for supplying magnetron driving power, fan motor driving power, and turntable motor driving power under control of the microcomputer 1, a magnetron 3 for generating a microwave by being driven by the magnetron driving power from the driving section 2, a heating chamber 7 for heating the food positioned on a turntable 8 with the microwave generated at the magnetron 3, a cooling fan motor 5 which is actuated by the fan motor driving power from the driving section 2, a cooling fan 6 for blowing air in the heating chamber 7 through an air inlet 10 and cooling the magnetron 3 upon activation by the cooling fan motor 5, a turntable motor 9 for rotating the turntable 8 by being actuated by the turntable motor driving power from the driving section 2, and a weight sensing section 4, disposed below the heating chamber 7, for detecting the weight of the food and applying the detected weight signal to the microcomputer 1 as an electrical signal.

With reference to FIG. 2 the operation of the conventional microwave oven is described below.

Upon pressing a button for cooking in a state that the food to be cooked is positioned on the turntable 8 within the heating chamber 7, the microcomputer 1 executes an initial heating operation.

That is, the cooling fan 6 is actuated for a predetermined time by the driving section 2 to blow air into the heating chamber 7 so that the air temperature within the heating chamber 7 is uniform.

When the predetermined time has elapsed, the microcomputer 1 actuates the turntable motor 9 to rotate the turntable 8 on which the food to be cooked is positioned, and the magnetron 3 is driven by the driving section 2 to heat the food within the heating chamber 7. On the other hand, the weight sensing section 4 disposed below the heating chamber 7 detects the weight of food and converts the detected weight signal into an electrical signal and applies it to the microcomputer 1. As a result, the microcomputer 1 stores the weight signal W1 therein and multiplies the weight signal W1 by a predetermined constant C responsive to the kinds of food, thereby calculating a first stage heating time T1, as shown in FIG. 2.

The magnetron 3 is strongly actuated for the first stage heating time T1 calculated as above, and thus the food within the heating chamber 7 is heated as time elapses.

Thereafter, upon completion of the first stage heating time T1, the microcomputer 1 executes a second stage heating operation by calculating a second stage heating time KT1 by multiplying the first stage heating time T1 by a predetermined constant K and weakly actuates the magnetron 3 for the calculated second stage heating time KT1 to continuously heat the food.

Thereafter, when the second stage heating time KT1 elapses, that is, when the whole cooking time T2 has elapsed, the magnetron 1 stops the driving of the magnetron 3, the cooling fan 6 and the turntable motor 9 and finishes the cooking operation.

In such a conventional microwave oven, the first stage heating time is calculated by multiplying the weight of food detected at the weight sensing section by a predetermined constant in accordance with the kinds of food and the first stage heating operation is executed for the first stage heating time, but it executes the cooking operation indiscriminately with respect to the food of same kind and weight irrespective of the condition and shape of the food, resulting in the over heating or incomplete heating of the food.

Furthermore, since the first stage heating is executed for the first stage heating time which is calculated in response to the weight signal, the reliability of cooking becomes lower in the region where the voltage level is not irregular, and in case that an error occurs in the weight sensing signal of food detected at the weight sensing section, the cooking time may also involve an error, thereby causing the cooking condition to be poor.

SUMMARY OF THE INVENTION

Accordingly it is an object of the present invention to provide a method and an apparatus for automatic cooking in a microwave oven which are capable of executing an automatic cooking operation in an optimal state by calculating a first stage heating time by a fuzzy operation in response to an outflow air temperature difference and the weight of food to be cooked.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to an apparatus for automatic cooking which includes a weight sensing section for sensing a weight of food positioned on a turntable of a heating chamber; an outflow air temperature sensor for detecting a temperature of the outflow air from the heating chamber; a first analog/digital converter for converting a weight signal detected and amplified at the weight sensing section into a digital signal; a second analog/ditital converter for converting an outflow air temperature signal detected and amplified at the outflow air temperature sensor into a digital signal; a fuzzy controller for receiving output signals from the first and second analog/digital converters to generate a fuzzy function and executing an operation process in response to a fuzzy rule to output first stage heating time data; and a microcomputer for driving a magnetron and a cooling fan motor for a time in response to the first stage heating time data of the fuzzy controller in order to execute a cooking operation.

In accordance with another aspect of the present invention a method for automatic cooking in a microwave oven is provided with includes the steps of: storing a weight sensing signal of food positioned on a turntable of a heating chamber in an initial stage of an automatic cooking and an outflow air temperature sensing signal of the heating chamber; calculating an outflow air temperature difference which is a difference value between a newly inputted outflow air temperature and the outflow air temperature which has previously been stored, by executing a cooking operation by driving the cooling fan motor and the magnetron for a predetermined time and by receiving an outflow air temperature sensing signal of the heating chamber when the predetermined time has elapsed; calculating an additional value by giving a fuzzy membership function with respect to the weight and the outflow air temperature difference and calculating a first stage heating time by executing an operation process with respect to the additional value in response to a fuzzy rule; calculating a second, a third, a fourth and a fifth stage heating times by muliplying the first stage heating time by a predetermined value, respectively; and executing a cooking operation for the first stage heating time and then for the second, third, fourth and fifth stage heating times, consecutively.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein:

FIG. 1 is a graph showing an increasing rate of the heating time in response to a weight of food according to the conventional microwave oven;

FIG. 6 is an explanatory view of a fuzzy rule of the fuzzy controller of FIG. 3;

FIGS. 7A to 7C are explanatory views for giving a fuzzy membership function with respect to the outflow air temperature difference according to the present invention, in which, FIG. 7A is graph showing a case that the outflow air difference is a large value (PL);

FIG. 7B is a graph showing a case that the outflow air difference is a middle value (PM);

FIG. 7C is a graph showing a case that the outflow air temperature is a small value (PS);

FIGS. 8A to 8C are explanatory views showing examples for giving the fuzzy membership function with respect to the weight according to the present invention, in which:

FIG. 8A is a graph showing a case that the weight is a large value (PB);

FIG. 8B a graph showing a case that the weight is a middle value (PM); and

FIG. 8C is a graph showing a case that the weight is a small value (PS); and FIGS. 9A to 9C are explanatory views showing examples for giving the fuzzy membership function with respect to the heating time according to the present invention, in which;

FIG. 9A is a graph showing a case that the heating time is long (PL);

FIG. 9B is a graph showing a case that the heating time is a middle value (PM); and FIG. 9C is a graph showing a case that the heating time is short (PS); and FIG. 10A

DESCRIPTION OF THE PREFERRED EMBODIMENTS

Figure 1:
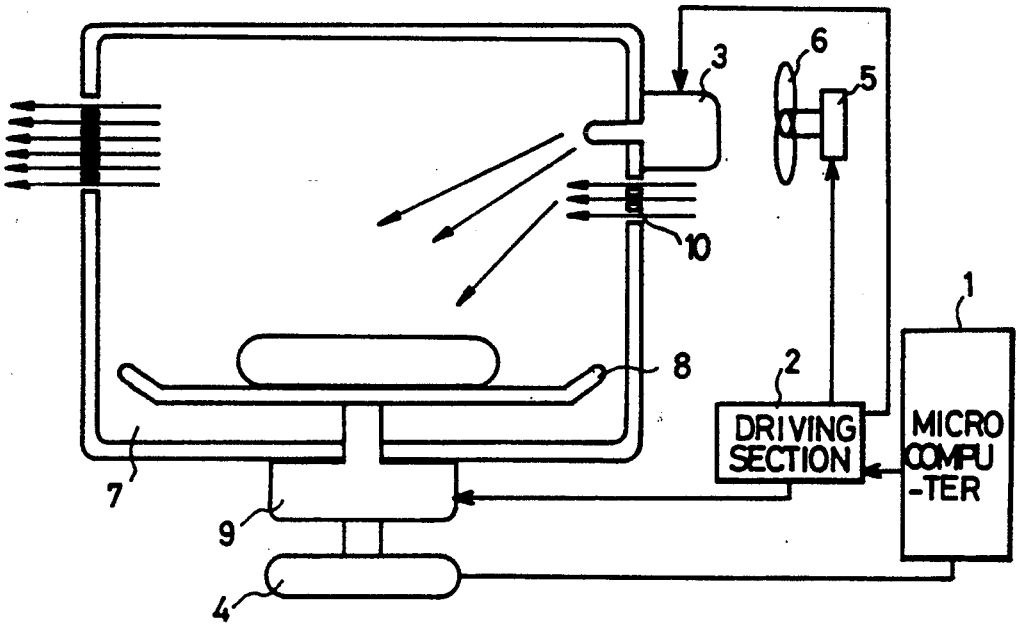
FIG. 1 PRIOR ART
FIG. 1 is a block diagram of a conventional microwave oven.
Figure 2:
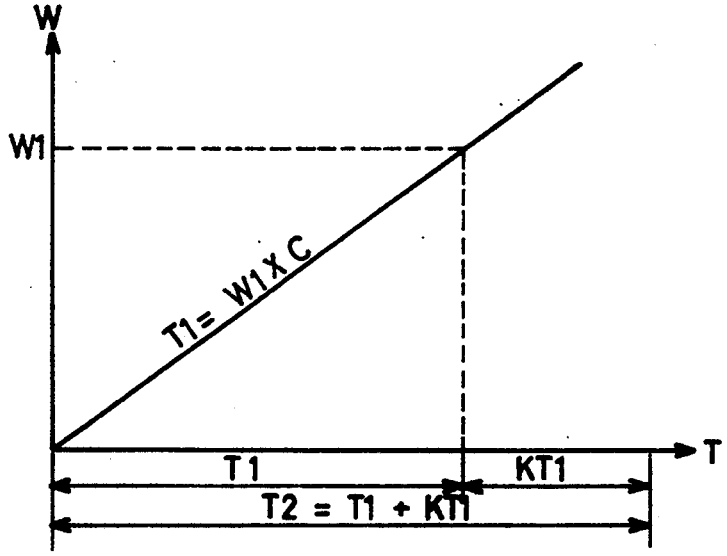
FIG. 2 PRIOR ART.
Figure 3:
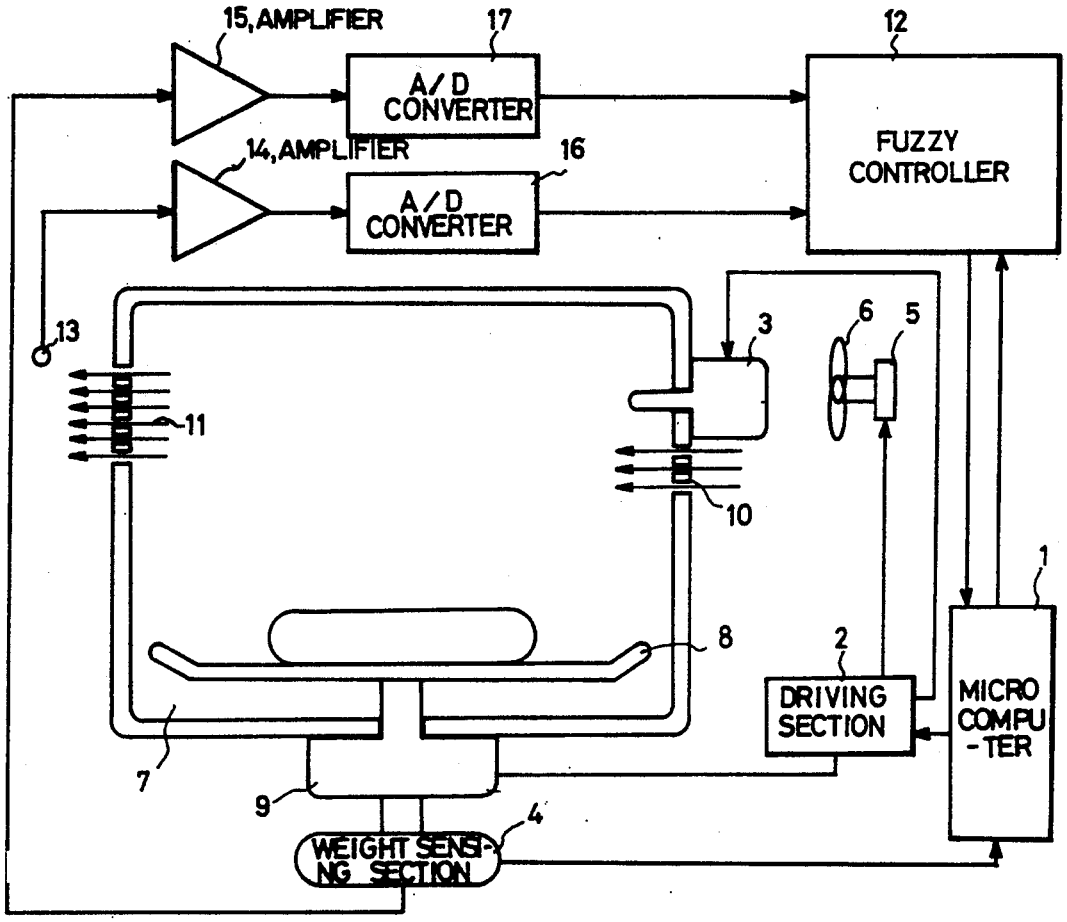
FIG. 3 is a block diagram of an automatic cooking apparatus of the present invention.

Referring now in detail to the drawings for the purpose of illustrating preferred embodiments of the present invention, the automatic cooking apparatus for use in a microwave oven as shown in FIG. 3, which comprises a microcomputer 1 for controlling the whole operations of the system, a driving section 2 for supplying a fan motor driving power and a turntable motor driving power, a magnetron 3 for generating a microwave by being driven by the magnetron driving power from the driving section 2, a heating chamber 7 for heating food positioned on a turntable 8 with the microwave generated at the magnetron 3, a cooling fan motor 5 which is driven by the cooling fan driving power from the driving section 2, a cooling fan 6 for blowing air through an inlet 10 of the heating chamber 7 in order to cool the magnetron 3 upon rotating by the driving of the cooling fan motor 5, a turntable motor 9 for rotating the turntable 8 by being driven by the turntable driving power from the driving section 2, a weight sensing section 4, disposed below the heating chamber 7, for detecting the weight of food and converting the detected weight signal into an electrical signal, an outflow air temperature sensor 13 for detecting the temperature of the air which is discharged through an outlet 11 of the heating chamber 7, amplifiers 14 and 15 for amplifying the outflow air temperature detected at the outflow air temperature sensor 13 and the weight signal detected at the weight sensing section 4 into a predetermined level, analog/digital converters 16 and 17 for converting the analog signals amplified at the amplifiers 14 and 15 into digital signals, and a fuzzy controller 12 for calculating a cooking time by executing an operation with respect to the outflow air temperature signal and the weight signal for food, which are outputted from the analog/digital converters 16 and 17, upon the control of the microcomputer 1, and converting the value of the calculated cooking time into a digital signal in order to apply it to the microcomputer 1.

Figure 4:
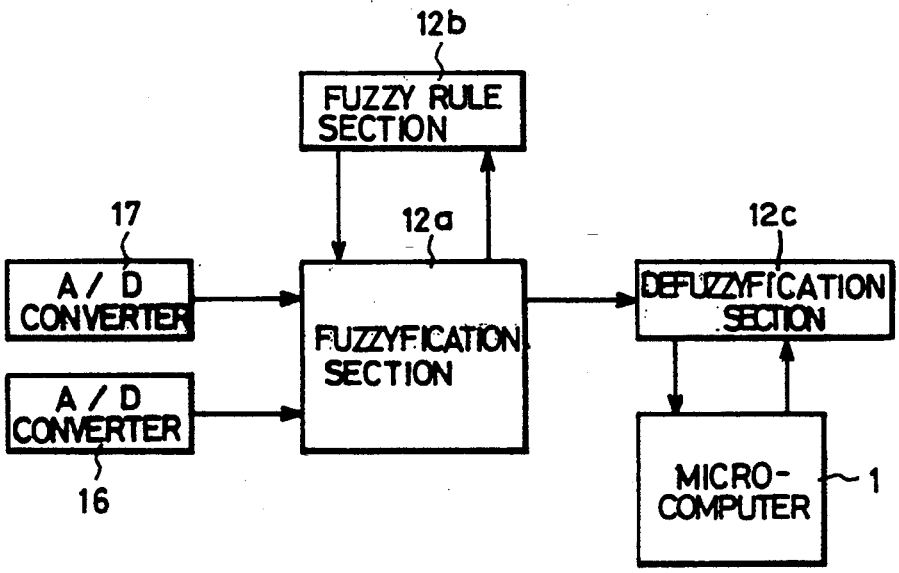
FIG. 4 is a detailed block diagram of a fuzzy controller of FIG. 3.

Referring to FIG. 4 which shows the fuzzy controller 12, which includes a fuzzification section **12*a* for giving a membership function to the outflow air temperature signal and the weight signal of food which are outputted from the analog/digital converters 16 and 17, a fuzzy rule section 12*b* for executing an operation process with respect to the data outputted from the fuzzification section 12*a* in response to a fuzzy rule and outputting the operated data to the fuzzification section 12*a*, and a defuzzification section 12*c* for converting the data outputted from the fuzzification section 12*a* into a digital signal and inputting the digital signal to the microcomputer 1**.

The operation of the present invention will now be described hereinafter with reference to FIG. 3 to FIG. 10A and FIG. 10B.

Figure 5:
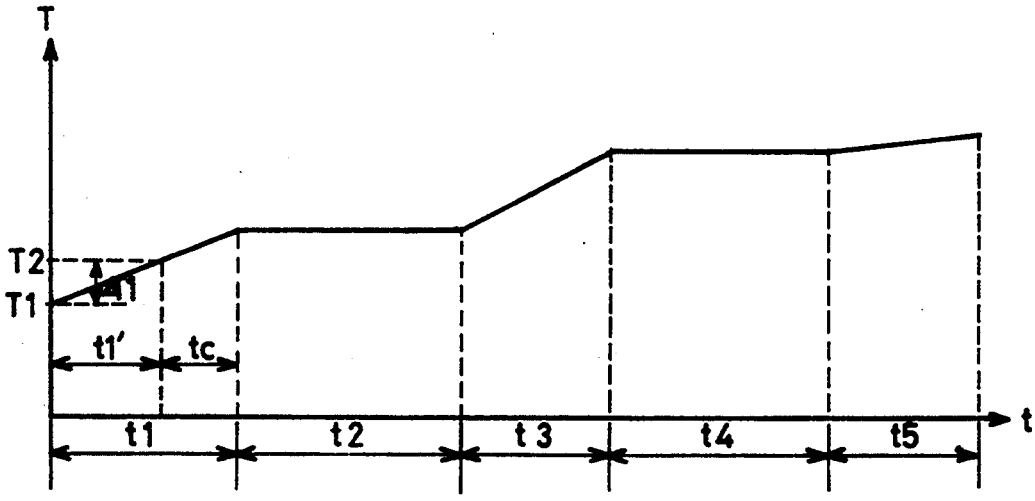
FIG. 5 is a graph showing the heating characteristics of the automatic cooking in the microwave oven of FIG. 3.

When a key for automatic cooking on a key board is pressed in a state that food to be cooked is positioned on the turntable 8 within the heating chamber 7, the microcomputer 1 executes a preliminary operation for a predetermined time t', as shown in FIG. 5. That is, the microcomputer 1 actuates the magnetron 3 and the cooling fan motor 5 through the driving section 2. At this moment, a weight sensing signal W1 which is detected at the weight sensing section 4 is amplified at the amplifier 15 and coverted into a digital signal at the analog/digital converter 17 and then applied to the fuzzy controller 12. Also, the temperature of the outflow air which is discharged through the outlet 11 of the heating chamber 7 is detected at the outflow air temperature sensor 13, amplified at the amplifier 14, converted into a digital signal at the analog/digital coverter 16 and then applied to the fuzzy controller 12.

Accordingly, at an initial stage of the preliminary operation, the weight signal W1 of food and the temperature signal T1 of the outflow air are stored in the microcomputer 1 through the fuzzy controller 12, and when a predetermined time t' has elapsed, a temperature signal T2 of the outflow air is received again by the microcomputer 1 in the same manner as above so that an outflow air temperature difference (ΔT1=T2=T1) is calculated. Thereafter, the fuzzification section 12*a* of the fuzzy controller 12 gives a fuzzy membership function to the weight signal W1 of food and the outflow air temperature difference ΔT1 in accordance with the fuzzy rule which has been stored in the fuzzy rule section 12*b*, and outputs an additional value in response to the weight signal W1 and the outflow air temperature difference ΔT1. And, the defuzzification section 12*c* of the fuzzy controller 12 converts an additional value for the weight signal W1 and the outflow air temperature signal ΔT1, which are outputted from the fuzzification section 12*a*, into a digital signal and applied it to the microcomputer 1. Thus, the microcomputer 1 stores the signals input therein.

Thereafter, the micrcomputer 1 calculates a first stage heating time t1 by means of the fuzzy controller 12 in terms of the weight signal W1 and the outflow air temperature difference ΔT1, stores the first heating time t1 to a data RAM and calculates a second stage heating time t2 through a fifth stage heating time t5 by multiplying the first stage heating time t1 by a predetermined value.

That is, the micrcomputer 1 actuates in maximum the magnetron 3 and the cooling fan 6 for the first stage heating time t1 to heat the food within the heating chamber 7 and when the first stage heating time t1 has elapsed, the microcomputer 1 calculates the second stage heating time t2 by multiplying the first stage heating time t1 by a predetermined value α1 and actuates weakly the magnetron 3 for the second stage heating time t2 to heat the food, and also when the second stage heating time t2 has elapsed, the microcomputer 1 calculates the third stage heating time t3 by multiplying the first stage heating time t1 by a predetermined value α2 and actuates the magnetron 3 in maximum for the third stage heating time t3 to heat the food. Thereafter, when the third stage heating time t3 has elapsed the microcomputer 1 calculates the fourth stage heating time t4 by multiplying the first stage heating time t1 by a predetermined value α3 and actuates weakly the magnetron 3 for the calculated fourth stage heating time t4 to heat the food. When the fourth stage heating time t4 has elapsed, the fifth stage heating time t5 is calculated in the same manner as above, that is, by multiplying the fourth stage heating time t4 by a predetermined value α4 and the magnetron 3 is actuated in maximum for the fifth stage heating time t5. When the fifth stage heating time t5 has elapsed, the magnetron 3 and the cooling fan 5 are stopped in their operations and thus the heating of the food is completed.

In the above, the values α1, α2, α3 and α4 are set to 1.6, 0.4, 1.6 and 0.4, respectively.

And, the fuzzy rule in accordance with the weight signal W1 and the outflow air temperature difference ΔT1 is formulated as shown in FIG. 6.

In FIG. 6, fuzzy rule "1" means that an additional heating time (tc=t1−t1') is a positive middle value (PM) in the first stage heating time t1 in case that the outflow air temperature difference is a positive big value (PB) and the weight is heavy, i.e. a big value (PB). That is, since that the weight of food is large and the outflow air temperature difference is large means that the food is heated in medium and the cooking is in the course of being executed, the heating time tc is set to a middle value (PM) and in the same manner the remaining nine fuzzy rules can be formulated.

Furthermore, in the fuzzy rule "2", the heating time tc is set to a middle value (PM) in case that the outflow air temperature difference is a big value (PB) and the weight is a middle value (PM), similarly to the fuzzy rule "1".

And, the increase of the weight means an extension of the heating time tc and the decrease of the outflow air temperature difference ΔT1 means an extension of the heating time tc in the establishment of the heating time tc.

In the same manner as mentioned above, fuzzy rule "3" is a rule that the heating time tc is set to a small value (PS) in case that the outflow air temperature difference is large (PB) and the weight is light (PS), fuzzy rule "4" is a rule that the heating time tc is set to large value (PL), i.e., long in case that the outflow air temperature difference is middle (PM) and the weight is large (PB), fuzzy rule "5" is a rule that the heating time tc is set to a middle value (PM) in case that the outflow air temperature difference is middle (PM) and the weight is middle (PM), fuzzy rule "6" is a rule that the heating time tc is set to a small value (PS) in case that the outflow air temperature difference is middle (PM) and the weight is small (PS), fuzzy rule "7" is a rule that the heating time tc is set to a large value (PL) in case that the outflow air temperature difference Is small (PS) and the weight is middle (PM), and fuzzy rule "9" is a rule that the heating time tc is set to a middle value (PM) in case that the outflow air temperature difference is small (PS) and the weight is small (PS).

Figure 7A:
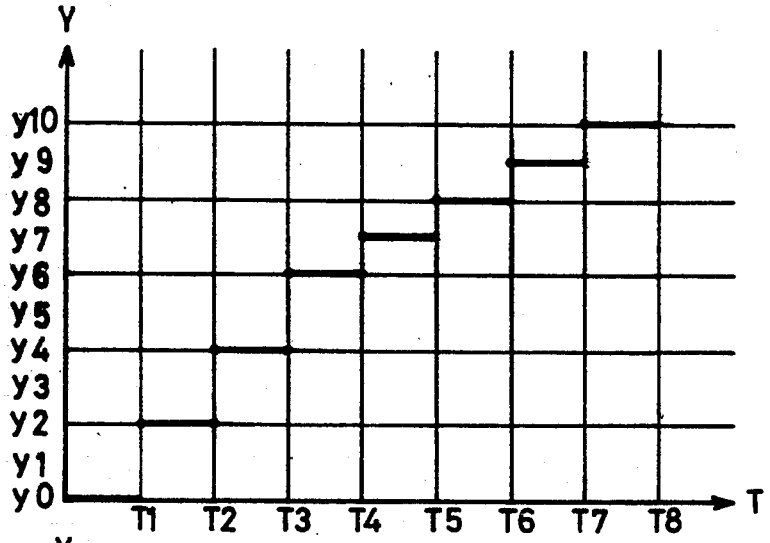
Figure 7B:
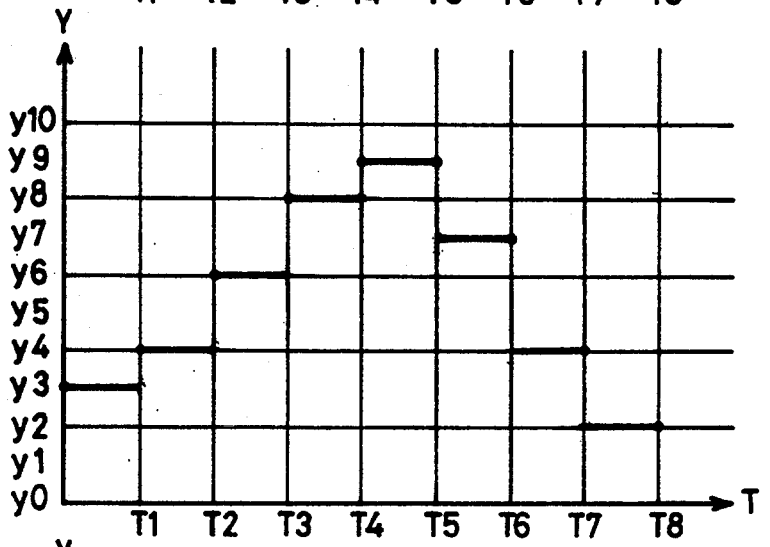
Figure 7C:
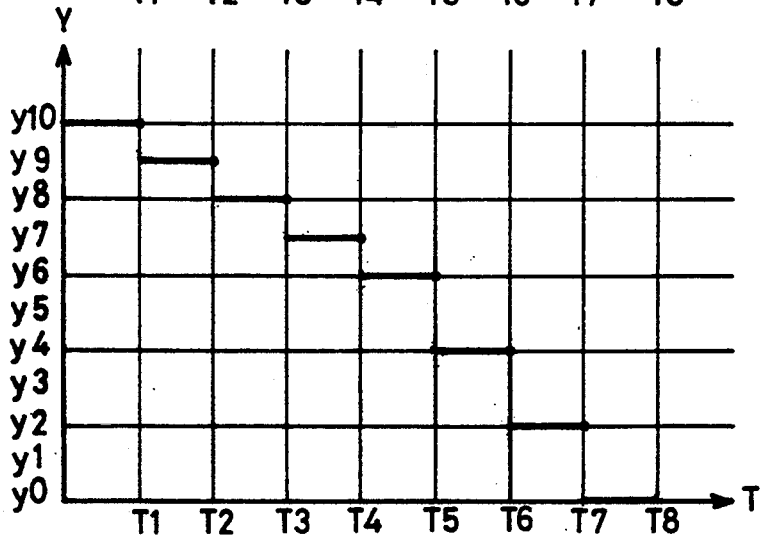

The fuzzy controller 12 provides the fuzzy membership function with respect to the outflow air temperature difference, as shown in FIGS. 7A to 7C.

The outflow air temperature difference ΔT1 is divided into eight regions T1–T8, that is, T1=below 3° C., T2=4° C., T3=5° C., T4=6° C., T5=7° C., T6=8° C., T7=9° C., and T8=10° C., and gives an additional value Y with respect to the eight regions for the cases that the outflow air temperature difference ΔT1 is small (PS), middle (PM) and large (PB). And then the additional value Y is divided into eleven regions, that is y0=0.0, y1=0.1, y2=0.2, y3=0.3, y4=0.4, y5=0.5, y6=0.6, y7=0.7, y8=0.8, y9=0.9 and y10=1, and in case that each outflow air temperature difference ΔT1 is small (PS), additional values Y10=1.0, y9=0.9, y8=0.8, y7=0.7, y6=0.6, y4=0.4, y2=0.2 and y0=0.0 are given with respect to the outflow air temperature difference regions T1, T2, T3, T4, T5, T6, and T8, respectively, so as to be inverse proportional thereto, as shown in FIG. 7C.

In case that the outflow air temperature difference ΔT1 is middle (PM), additional values y3=0.3, y4=0.4, y6=0.6, y8=0.8, y9=0.9, y6=0.7, y4=0.4 and y2=0.2 are given with respect to the regions T1, T2, T3, T4, T5, T6, T7 and T8 of the outflow air temperature difference ΔT1, respectively, as shown in FIG. 7B.

While in case that the outflow air temperature difference is large (PB), additional values y0=0.0, y2=0.2, y4=0.4, y6=0.6, y7=0.7, y8=0.8, y9=0.9 and y10=1.0 are given with respect to the outflow air termperature difference regions T1, T2, T3, T4, T5, T6, T7 and T8, respectively, so as to be proportional thereto, as shown in FIG. 7A.

Figure 8A:
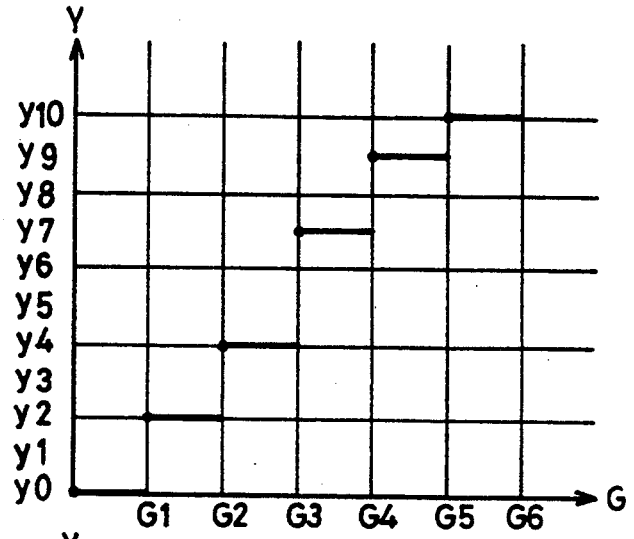
Figure 8B:
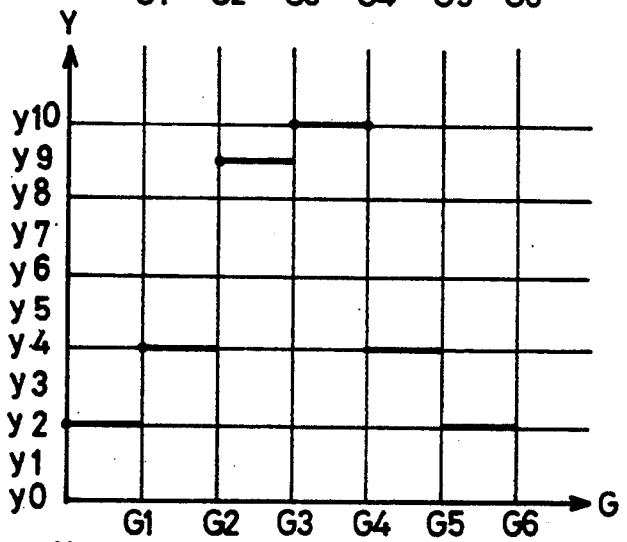
Figure 8C:
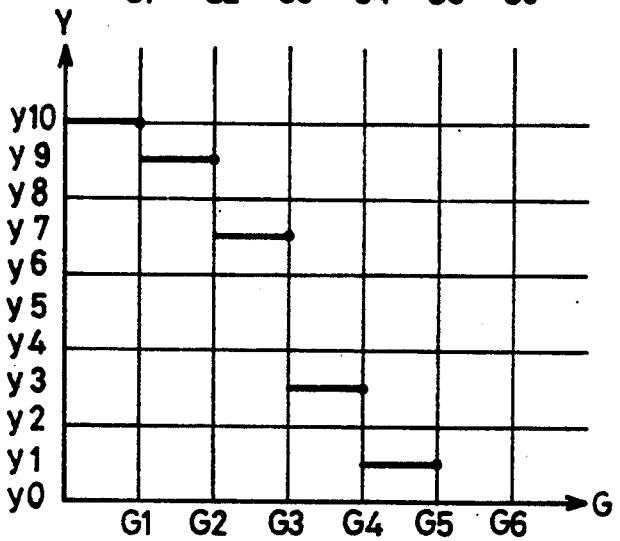

On the other hand, the fuzzy controller 12 gives the fuzzy membership function with respect to the weight of food, as shown in FIGS. 8A to 8C, The weight W1 is divided into six regions, i.e., G1=below 300 g, G2=400 g, G3=500 g, G4=600 g, G5=700 g, and G6=800 g and additional values are given with respect to the six regions for the cases that the weight W1 is a small value (PS), a middle value (PM) and a large value (PB). And then the additional value Y is divided into eleven regions, i.e., y0(0.0) to y10(1.0) and the additional value Y is given with respect to the respective regions G1–G6 of the weight W1.

If in case that the weight is light, i.e., a small value (PS), additional values y10=1.0, y9=07, y7=0.7, y3=0.3, y1=0.1 and y0=0.0 are given with respect to the regions G1, G2, G3, G4, G5 and G6 of the weight W1, respectively, so as to be inverse proportional thereto, as shown in FIG. 8C.

While in case that the weight is a middle value (PM), additional values y2=0.2, y4=0.4, y9=0.9, y10=1.0, y4=0.4 and y2=0.2 are given with respect to the regions G1, G2, G3, G4, G5 and G6 of the weight W1, respectively as shown in FIG. 8B.

In case that the weight is heavy, i.e., a large value (PB), additional values y0=0.0, y2=0.2, y4=0.4, y7=0.7, y9=0.9 and y10=1.0 are given with respect to the regions G1, G2, G3, G4, G5, G6, G7 and G8 of the weight W1, respectively, so as to be proportional thereto, as shown in FIG. 8A.

Figure 9A:
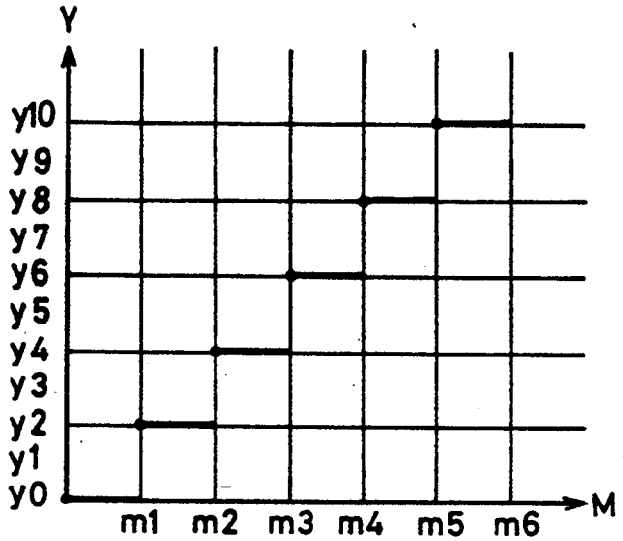
Figure 9B:
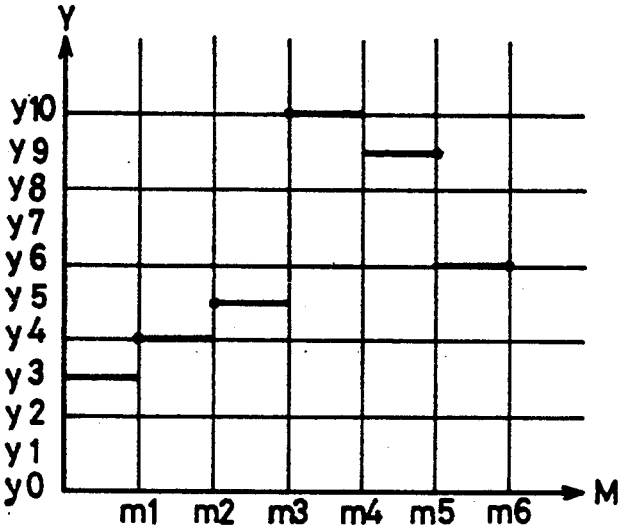
Figure 9C:
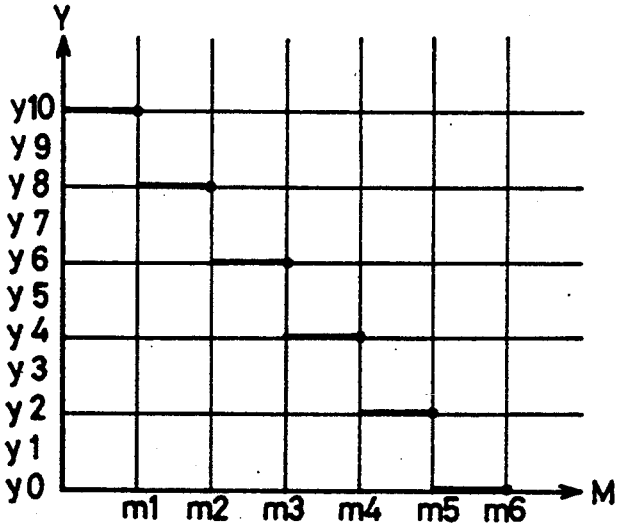
Figure 10A:
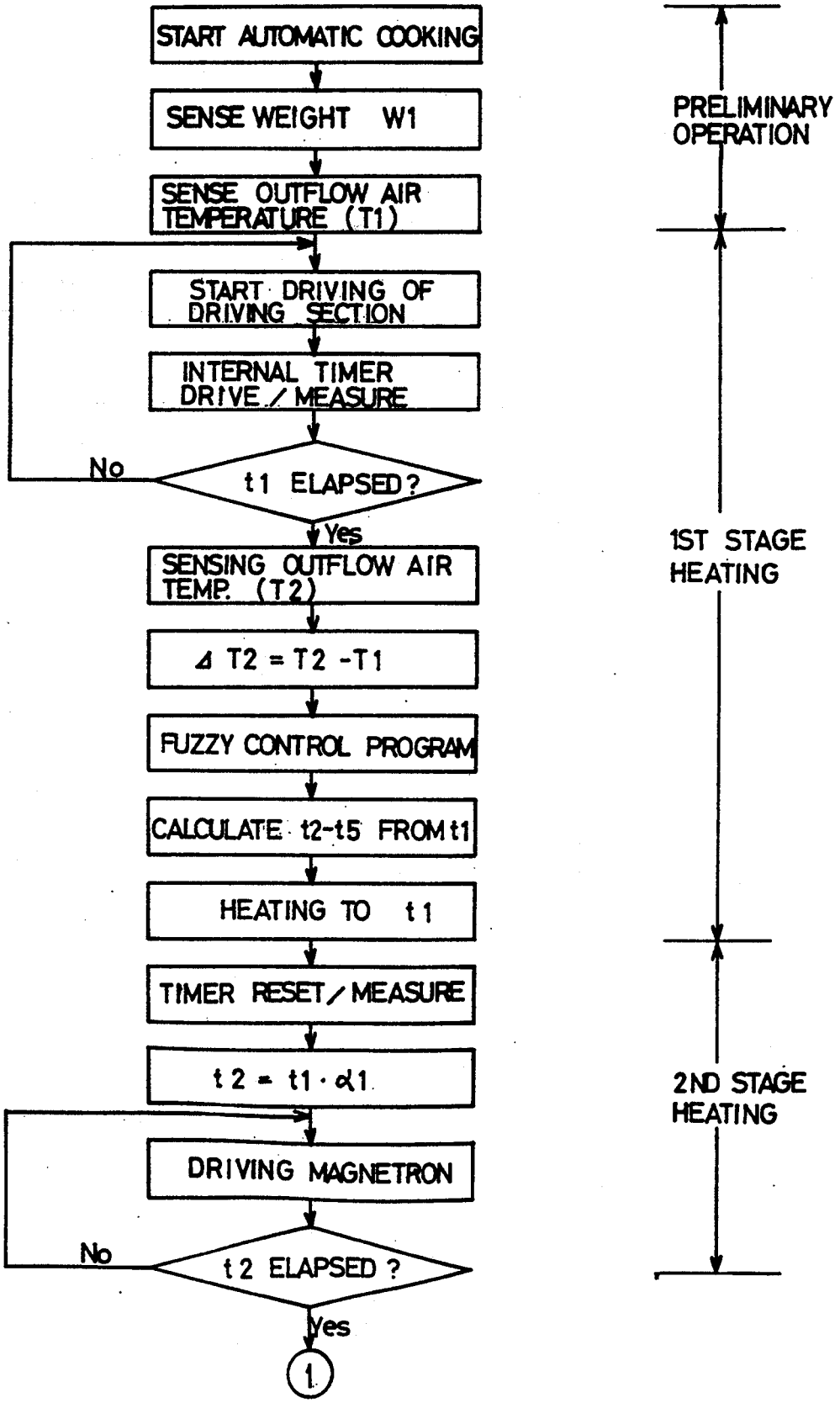
FIG. 10B is a flowchart for the automatic cooking method according to the present invention.
Figure 10B:
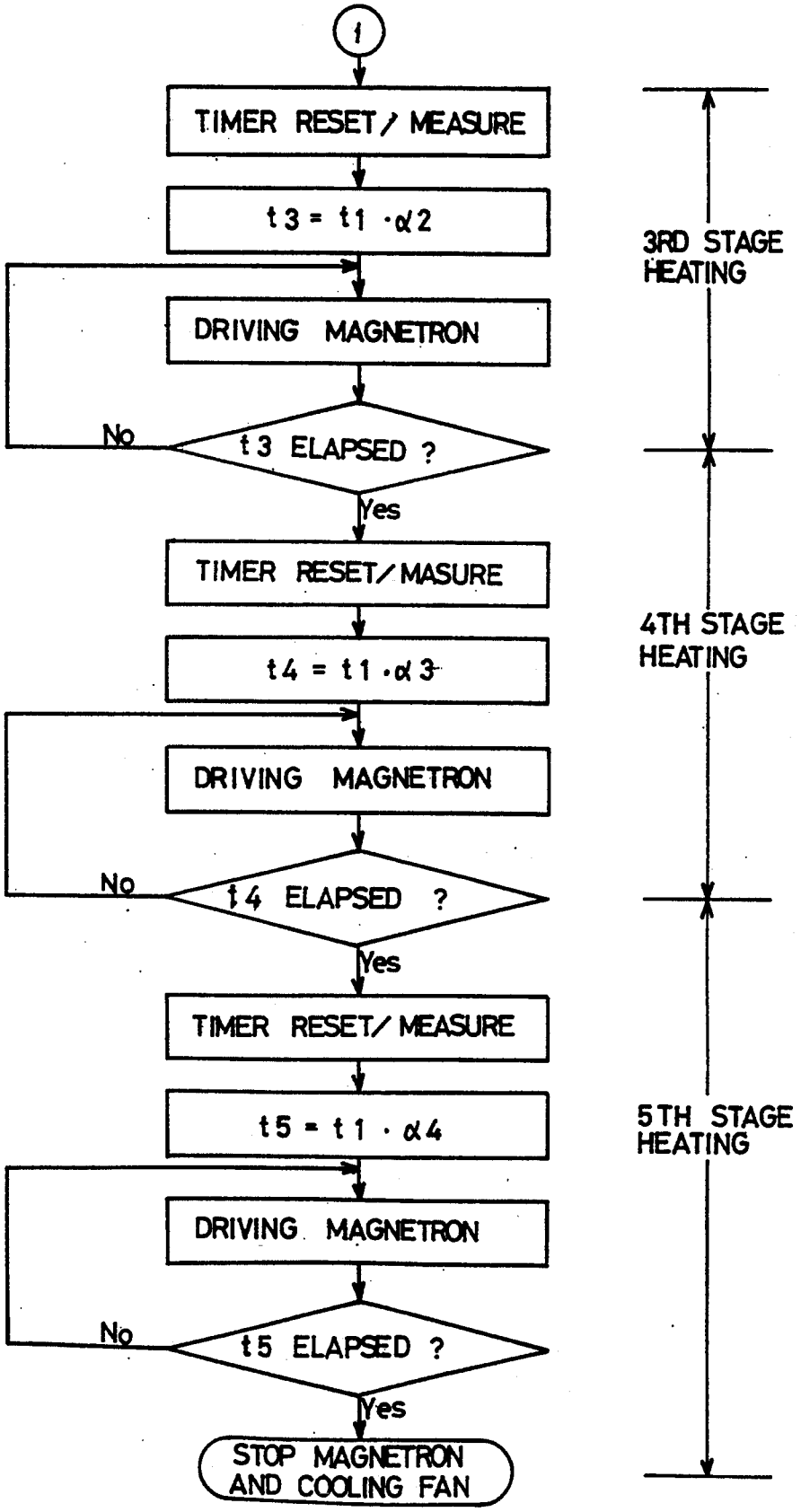

Meanwhile, the fuzzy controller 12 gives the membership function with respect to the heating time, as shown in FIGS. 9A to 9C.

That is, the heating time tc is divided into six regions, i.e. m1=below 30 seconds, m2=60 seconds, m3=90 seconds, m4=120 seconds, m5=150 seconds and m6=180 seconds and then the additional value Y is given, respectively, for the cases that the heating time tc is a small value (PS), a middle value (PM) and a large value (PL). In addition, the additional value Y is divided into eleven regions, i.e., y0(0.0) to y10(1.0) and the additional value Y is given with respect to the regions m1 to m6 of the heating time tc.

For example, in case that the heating time is short, i.e., a small value (PS), additional values y10, y8, y6, y4, y2 and y0 are given with respect to the regions m1 to m6 of the heating time tc, respectively, so as to be inverse proportional thereto, as shown in FIG. 9C, in case that the heating time is a middle value (PM), additional values y3, y4, y5, y10, y9 and y6 are given with respect to the regions m1 to m6 of the heating time tc, respectively, as shown in FIG. 9B, and in case that the heating time is long, i.e., a large value (PL), additional values y0, y2, y4, y6, y8 and y10 are given with respect to the regions m1 to m6 of the heating time tc, respectively, as shown in FIG. 9A.

After giving the fuzzy rule and the fuzzy membership function as above, the heating time tc can be calculated by a fuzzy direct method and a fuzzy central method, as below.

For example, assuming that the outflow air temperature difference (ΔT1=T2−T1) is T6(8° C.), which is detected at the outflow air temperature sensor 13, and the weight W1 is G5 (700 g), which is detected at the weight sensing section 4, the cooking time tc is calculated through a fuzzy operation of the fuzzy controller 12, as below.

That is, the additional value y8 becomes 0.8 in case that the outflow air temperature difference is a large value (PB) in accordance with the fuzzy rule "1", as shown in FIG. 7A, and the additional value y9 becomes 0.9 in case that the weight W1 is a large value (PB), as shown in FIG. 8A.

Accordingly, the additional value Y1 in accordance with the fuzzy rule "1" is set by selecting a minimum value (indicated as "∧") between the additional values y8(0.8) and y9(0.9). That is, the additional value Y becomes Y1=y8(0.8)∧ y9(0.0)=y8(0.8), and in the same manner the additional value Y2 in accordance with the fuzzy rule "2" becomes Y2=y8 (0.8) ∧ y4(0.4)=y4(0.4), and the additional value Y3 for the fuzzy rule "3" becomes Y3=y8(0.8)∧ y1(0.1)=y1(0.1). Similarly, the additional values Y4 to Y9 for the fuzzy rules "4" to "9" can be determined as Y4=y7(0.7)∧ y9(0.9)=y7(0.7), Y5=y7(0.7)∧ y4(0.4)=y4(0.4), Y6=y7(0.7)∧ y1 (0.1)=y1(0.1), ∧ Y7=y4(0.4) ∧y9(0.9)=y4(0.4), Y8-=y4(0.4) ∧ y4(0.4)=y4(0.4), and Y9=y4(0.4) ∧ y1(0.1-)=y1(0.1).

When the additional values Y1 to Y9 for the fuzzy rules "1" to "9" are determined, an operation is executed.

That is, in case that the heating time tc is long, i.e., a large value (PL), this case corresponds to the fuzzy rules "4" and "7" in the fuzzy rule table of FIG. 6. Accordingly, a maximum value (indicated as "V") between the additional value y7(0.7) for the fuzzy rule "4" and the additional value y4(0.4) for the fuzzy rule "7" is selected as an additional value Ya for the case that the heating time tc is long, i.e., a large value (PL). That is, a maximum value y7(0.7) between the additional values y7(0.7)and y4(0.4) for the fuzzy rules "4" and "7" is substituted for the additional value Ya. In the same manner, in case that the heating time tc is middle (PM), the additional value Yb is calculated as yb=Y1VY2-VY5VY8VY9=y8(0.8)Vy4(0.4)Vy4(0.4)y4(0.4-)Vy1(0.1)=y8(0.8), and in case that the heating time tc is short, i.e., a small value (PS), the additional value Yc is calculated as Yc=Y3VY6=y1(0.1)V y1(0.1-)=y1(0.1).

Thereafter, an operation for selecting a minimum value (indicated as "∧") is executed between the additional value Ya which has been obtained as above and additional values corresponding to respective times, m1=below 30 seconds, m2=60 seconds, m3=90 seconds, m4=120 seconds, m5=150 seconds and m6=180 seconds for the case that the heating time tc is a large value (PL).

That is, in case that the heating time tc is a large value (PL), an additional value y10(1.0) is given for the region m6 of the heating time tc, as shown in FIG. 9A, and then a minimum value is selected between the additional value y10(1.0) and the additional value Ya y7 (0.7)).

And, since an additional value y8(0.8) is given for the region m5 of the heating time tc, a minimum value is selected between the additional value Ya (y7(0.7)) and y8(0.8), and in the same manner an additional value y6(0.6) for the region m4(120 seconds) of the heating time tc, y4(0.4) for the region m3(90 seconds), y2(0.2) for the region m2(60 seconds), and y0(0.0) for the region m1(below 30 seconds) are obtained, respectively.

That is, the additional value Ya for the case that the heating time tc is large (PL) and the additional value for the heating time tc are obtained as Ya ∧ tc=y7 ∧ yo/m-1+y7 ∧ y2/m2+y7 ∧ y4/m3+y7 ∧ y 6/m4+y7 ∧ y8/m5+y7 ∧ y10/m6, the additional value Yb for the case that the heating time tc is middle (PM) and the additional value for the heating time tc are obtained as Yb ∧ tc=y8 ∧ y3/m1+y8 ∧ y4/m2+-m8 ∧ y5/m3+y8 ∧ y10/m4+y8 ∧ y9/m5+y8 ∧ y6/m8, and the additional value Yc for the case that the heating time tc is small (PS) and the additional value for the heating time tc are obtained as Yc ∧ tc=y1 ∧ y10/m-1+y1 ∧ y8/m2+y1 ∧ y6/m3+y1 ∧ y4/m-4+y1 ∧ y2/m5+y1 ∧ y0/m6.

When the operation is executed for the additional values Ya to Yc, each operation does have the additional values for all the time units (heating time units: m1=below 30 seconds, m2=60 seconds, m3=90 seconds, m4=120 seconds, m5=150 seconds and m6=180 seconds), and thus operations are executed again on the basis of the time units.

That is, when the heating time tc which has been calculated above is m1, i.e., below 30 minutes, since the additional value is y0(0.0) in case of Ya tc (PL), Yb(0.3) in case of Yb ∧ tc (PM), and y1(0.1) in case of Yc ∧ tc (PS), a maximum value (indicated as "V") is selected among the three additional values.

That is, a maximum value y3(0.3) is selected among the three additional values when the heating time tc is m1.

Similarly, when the heating time tc is m2 (60 seconds), since the additional value is y2(0.2) in case of Ya ∧ tc (PL), the additional value is y4(0.4) in case of Yb ∧ tc (PM), and the additional value is y1(0.1) in case of Yc ∧ tc (PS), the maximum additional value y4(0.4) is selected among the three additional values, and in the same manner, y5(0.5) for m3 (90 seconds), m8(0.8) for m4 (120 seconds), y8(0.8) for m5 (150 seconds), and y7(0.7) for m6 (180 seconds) are calculated as new additional values.

The additional values calculated as above are multiplied by the time, respectively, and the multiplied values are added together, and then divided by the sum of the new additional values in order to calculate the heating time tc.

That is, since the additional value is y3(0.3) in case that the heating time tc is m1, 30 seconds are multiplied by 0.3, and in the same manner the additional values for the cases that the heating time tc is m2 to m6 are multiplied by the corresponding times, respectively, and the sum of the multiplied values is divided by the sum of the additional values in order to calculate the heating time tc as follows.

$$tc = \frac{0.3 \times 30'' + 0.4 \times 60'' + 0.5 \times 90'' + 0.8 \times 120'' + 0.8 \times 150'' + 0.7 \times 180''}{0.3 + 0.4 + 0.5 + 0.8 + 0.8 + 0.7} = 120''$$

When the heating time tc is obtained as above, the first stage heating time t1 is calculated by adding the obtained heating time tc to the predetermined time t' at the initial stage, and the food is heated for the first stage heating time t1 by driving the magnetron 3 strongly. Upon completion of the first stage heating, the first stage heating time t1 is multiplied by a predetermined value $\alpha 1$ in order to calculate the second stage heating time t2 and then the magnetron 3 is driven weakly for the second stage heating time t2, thereby heating the food. Similarly, the third, the fourth and the fifth stage heating times t3, t4 and t5 are calculated by multiplying the first stage heating time t1 by predetermined values $\alpha 2$, $\alpha 3$ and $\alpha 4$, respectively, and then the magnetron 3 is driven for the third, the fourth and the fifth stage heating times t3, t4 and t5 to heat the food. And, when the fifth stage heating time t5 has elapsed, the driving of the magnetron 3 and the cooling fan 6 is stopped and thus, completing the cooking operation.

As described hereinabove, the present invention provides the effect that it is possible to execute in precise an automatic cooking by detecting the outflow air temperature difference and the weight of food and calculating correctly the heating time by a fuzzy operation in terms of the detected outflow air temperature difference and weight signals.

The invention being thus described, it will be obvious that the same may be varied in many ways, Such variations are not to be regarded as a departure from the spirit and scope of the invention, and all such modifications would be obvious to one skilled in the art are intended to be included in the scope of the following claims.

What is claimed is:

1. A method of automatic cooking in a microwave oven, comprising the steps of:

storing a weight sensing signal of food positioned on a turntable of heating chamber and an overflow air temperature sensing signal of the heating chamber in an initial stage of automatic cooking;

calculating an outflow air temperature difference between a newly input outflow air temperature sensing signal and a previously stored outflow air temperature sensing signal wherein the newly input outflow air temperature sensing signal is detected after a cooking operation for a predetermined time;

calculating an additional value by generating a fuzzy membership function with respect to a weight of the food and the outflow air temperature difference and calculating a first stage heating time from the additional value and a fuzzy rule;

calculating second, third, fourth and fifth stage heating times by multiplying the first stage heating time by second, third, and fourth predetermined values respectively; and executing a cooking operating for the first stage heating time and then for second, third, fourth, and fifth stage heating times, consecutively.

2. The method of claim 1, wherein said fuzzy rule divides the outflow air temperature difference into large, middle and small values, the weight is divided into large, middle and small values, an additional value for the heating time is set as middle, middle and small values, respectively when the weight is large, middle and small values, respectively when the outflow air temperature difference is the large value, the additional value for the heating time is the large, middle and small values, respectively when the weight is the large, middle and small values respectively when the outflow air temperature is a middle value, and the additional value for the heating time is the large, middle, and middle values, respectively, when the weight is the large, middle and small values, respectively when the outflow air temperature difference is a small value.

3. The method of claim 2, wherein the additional value for the weight is calculated when the weight is the large, middle and small values, respectively, the additional value for the outflow air temperature difference is calculated when the outflow air temperature difference is the large, middle and small values, respectively, an additional value responsive to the fuzzy rule is calculated by selecting a minimum value between the additional values for the outflow air temperature difference and the corresponding additional values for the weight, an additional value is calculated by selecting a maximum value among the additional values when the heating time responsive to the fuzzy rule is large, middle and small values, additional values for the heating time are calculated, respectively, by selecting a minimum value between an additional value previously calculated and the additional values corresponding to respective time units when the heating time is the large, middle and small values, a final additional value for the heating time unit is calculated by selecting a maximum value among the additional values for the corresponding heating time units, a heating time is calculated by multiplying the final additional value by corresponding time units and adding the multiplied values and then dividing an added value by a sum of a final additional value, and a first stage heating time is calculated by adding the heating time to the predetermined time which is a heating time at the initial stage.

4. The method of claim 2, wherein said fuzzy membership function for the outflow air temperature difference is given by the following steps of:

dividing the outflow air temperature difference into predetermined temperature units;

setting the additional value to be proportional to the temperature units when the outflow air temperature is a large value;

setting the additional value to be proportional to the temperature unit up to the middle temperature unit and setting the additional value to be inversely proportional to the temperature unit after the middle temperature unit when the outflow air temperature difference is a middle value; and setting the additional value to be inversely proportional to the temperature unit when the outflow air temperature difference is a small value.

5. The method of claim 2, wherein a weight membership function is given by the following steps of:

dividing the weight into predetermined units;

dividing the additional value for the weight into predetermined units;

setting the additional value to be proportional to the weight unit when the weight is a large value;

setting the additional value to be proportional to the weight unit up to the middle weight unit and setting the additional value after the middle weight unit to be inversely proportional to the weight unit when the weight is a middle value; and setting the additional value to be inversely proportional to the weight unit when the weight is a small value.

6. The method of claim 2, wherein the membership function for the heating time is calculated by the following steps of:

dividing the heating time into predetermined time units;

dividing the additional value for the heating time into predetermined units;

setting the additional value to be proportional to the time units when the heating time is a large value;

setting the additional value to be proportional to the time units upon to the middle time unit and setting the additional value to be inversely proportional to the time units after the middle time unit when the heating time is a middle value; and setting the additional value to be inversely proportional to the time units when the heating time is a small value.

7. The method of claim 1, wherein the second, third, fourth and fifth stage heating times are calculated by multiplying the first stage heating time by 1.6, 0.4, 1.6, 0.4, respectively.

8. The method of claim 1 or claim 7, wherein the magnetron is driven strongly for the first, third and fifth stage heating times and the magnetron is driven weakly for the second and fourth stage heating times.

* * * * *